US006073351A

United States Patent [19]

Barnett

[11] Patent Number: 6,073,351

[45] Date of Patent: Jun. 13, 2000

[54] SIGHT MOUNTING FOR WEAPONS SUCH AS CROSSBOWS

[76] Inventor: Bernard Thomas Barnett, Caynton Hall, Ryton, Beckbury, Nr. Shifnal, Shropshire, TF11 9JQ, United Kingdom

[21] Appl. No.: 09/023,597

[22] Filed: Feb. 13, 1998

[51] Int. Cl.[7] ..... F41G 1/02

[52] U.S. Cl. ..... 33/252; 33/247

[58] Field of Search ..... 42/100; 33/247, 33/252; 124/25

[56] References Cited

U.S. PATENT DOCUMENTS

| | | | |
|---|---|---|---|
| 2,155,391 | 4/1939 | Arden | 33/247 |
| 2,335,881 | 12/1943 | Persinger | 42/100 |
| 2,561,909 | 7/1951 | Cobb | 33/56 |
| 3,165,836 | 1/1965 | Magardo | 42/100 |
| 4,417,403 | 11/1983 | Strange | 33/265 |
| 4,660,289 | 4/1987 | Wilhide | 33/247 |
| 4,875,290 | 10/1989 | Finch | 33/265 |
| 5,437,260 | 8/1995 | King | 124/25 |

FOREIGN PATENT DOCUMENTS

| | | | |
|---|---|---|---|
| 27178 | 12/1902 | United Kingdom | 33/247 |
| 27332 | 12/1908 | United Kingdom | 33/252 |
| 10 | 7/1910 | United Kingdom . | |

*Primary Examiner*—Charles T. Jordan
*Assistant Examiner*—Denise J Buckley
*Attorney, Agent, or Firm*—Mark R. Wisner

[57] ABSTRACT

A crossbow or other weapon with an adjustable sight mounting member is provided with an indicator mechanism which provides a read-out indicative of the disposition of the sight mounting member, the indicator being of a size substantially greater than the range of adjustment of the sight mounting member so as to provide a readily legible visual indication of said disposition. The indicator comprises a pointer rotatably movable over an arcuate scale and driven by a rack and pinion connection with an operating member which is coupled with the sight mounting member. The sight mounting member is adjustable by means of a screw which is operable independently of the indicator.

13 Claims, 3 Drawing Sheets

SIGHT MOUNTING FOR WEAPONS SUCH AS CROSSBOWS

DESCRIPTION OF INVENTION

This invention relates to sight mountings for weapons such as crossbows and rifles, and more particularly to such a weapon having a sight mounting which is adjustable in its attitude and/or position relative to the weapon.

Crossbows commonly are provided with telescopic sights. Such sights must be adjustable in respect of their attitude relative to the crossbow in order to ensure that the sight is set at the correct angle relative to the bow in accordance with the range at which the bow is to be used.

Although it has been proposed (in U.S. Pat. No. 4,660,289 for example) that such an adjustable sight mounting should have its adjustment effected by a screw device operated by the crossbow user, there still exists a problem in respect of providing an indication of the attitude of the sight mount relative to the bow. U.S. Pat. No. 4,660,289 discloses a pointer arm directly coupled to the sight mount and movable linearly over a fixed scale mounted on the bow. Since, however, a very small change in attitude of the sight relative to the bow makes a great difference in respect of the range for which the sight is accurate, such a direct reading scale and pointer arrangement does not provide the required accuracy for setting of the sight. Further, the setting is not readable "at a glance", requiring careful examination which the user of the crossbow may not find convenient under certain conditions.

It is broadly the object of the present invention to provide a crossbow wherein these disadvantages are overcome or reduced.

According to the present invention, we provide a sight mounting assembly comprising a base member adapted for mounting on a weapon, a sight mounting member adapted to carry a sighting device for the weapon, adjustment means for adjusting the disposition of said sight mounting member relative to said base member though a predetermined range of adjustment, and indicator means for providing a read-out indicative of the disposition of said sight mounting member relative to said base member, said indicator means comprising a display means of a size substantially greater than said range of adjustment of said sight mounting member so as to provide a readily legible usual indication of said disposition.

The indicator means preferably a mechanical movement-magnifying mechanism and said display means a scale and pointer mechanism.

The movement-magnifying mechanism may comprise an operating member which drives the scale and pointer mechanism. In one arrangement the operating member may coupled with said sight mounting member so as to move therewith and said display means is carried at a fixed position relative to said base member.

In an alternative arrangement the operating member may be coupled with said base member so as to remain in a fixed position relative thereto and said display means may be carried by said sight mounting member so as to move therewith.

In accordance with a further aspect of the invention we provide a weapon having a sight mounting member, an adjustment mechanism whereby said sight mounting member is adjustable in its disposition relative to the weapon, and an indicator which provides a read-out indicative of the disposition of the sight mounting member, the indicator being of a size substantially greater than the range of adjustment of the sight mounting member, so as to provide a readily legible visual indication of said disposition.

Operating means may be provided for coupling the indicator to the sight mounting member in such a way as to operate the indicator by movement of the sight mounting member, rather than being operated by the adjustment mechanism, so that it gives an indication of the true disposition of the sight mounting member and is not affected by any lost motion in the adjustment mechanism. Nevertheless, it may be possible to provide an operative connection directly between the adjustment mechanism and the indicator, providing the adjustment mechanism is such that there is no significant lost motion in its coupling with the sight mounting.

In one embodiment, said indicator may comprise a scale and pointer mechanism and said operating means comprise a mechanical movement-magnifying mechanism.

The scale and pointer mechanism is preferably rotationally operable.

Said operating means may include a connecting member which is coupled to the sight mounting member and is mounted for movement in accordance with the disposition of the sight mounting member, and rack and pinion means connecting the connecting member with said rotationally operable scale and pointer mechanism.

In one arrangement, said connecting member may be mounted for reciprocating movement relative to the crossbow.

The scale and pointer mechanism may be mounted on the sight mounting member.

The connecting member and the scale and pointer mechanism may be located within a part of the weapon, such as the stock, the scale and pointer mechanism being at least partially visible through a viewing aperture.

In an alternative arrangement, the indicator may be mounted on the sight mounting member.

The connecting member may comprise a pin mounted on the sight mounting member for linear movement relative thereto and may be held in a fixed position relative to a fixed element of the weapon.

The connecting member may be held in said fixed position by a resiliently deformable element, for example a coil compression spring.

The rack may comprise a threaded portion of the connecting member.

It will be understood that such a rotationally operable scale and pointer mechanism may comprise a pointer movable rotationally relative to a fixed circular or part-circular scale, or a circular or part-circular scale movable rotationally relative to a fixed pointer.

In an alternative embodiment, in which the indicator is coupled directly to the adjustment mechanism, a connecting member may be coupled to the sight mounting member and mounted for reciprocating movement relative to the crossbow by means of a rack and pinion connection with a manual rotary operating member whereby the connecting member drives the sight mounting member in response to operation of the manual operating member, and the indicator comprises a pointer element carried by said manual operating member and movable over a circular or part-circular scale. In this case the pointer element may also serve as a finger piece which is gripped by the user to turn the manual operating member.

Friction means are desirably provided to retain such manual operating member in any set position, and additionally or alternatively detent means may be provided to locate the manual operating member in any of a plurality of predetermined settings corresponding for example to standard ranges used in competition shooting.

In a further embodiment, the readily legible visible indication of the disposition of the sight mounting may be provided by means providing an electronic or digital readout of such disposition.

The digital readout may be provided by a unit which is of a type known for use in association with measuring instruments and the like, and which incorporates a digital display panel (e.g. of L.E.D. or liquid crystal display type) and an electronic circuit by which an input signal representing the detected position of a movable member is processed and operates the display panel.

The invention will now be described by way of example with reference to the accompanying drawings, in which FIG. 1 shows a first embodiment of the invention as applied to a crossbow.

Figure 1:
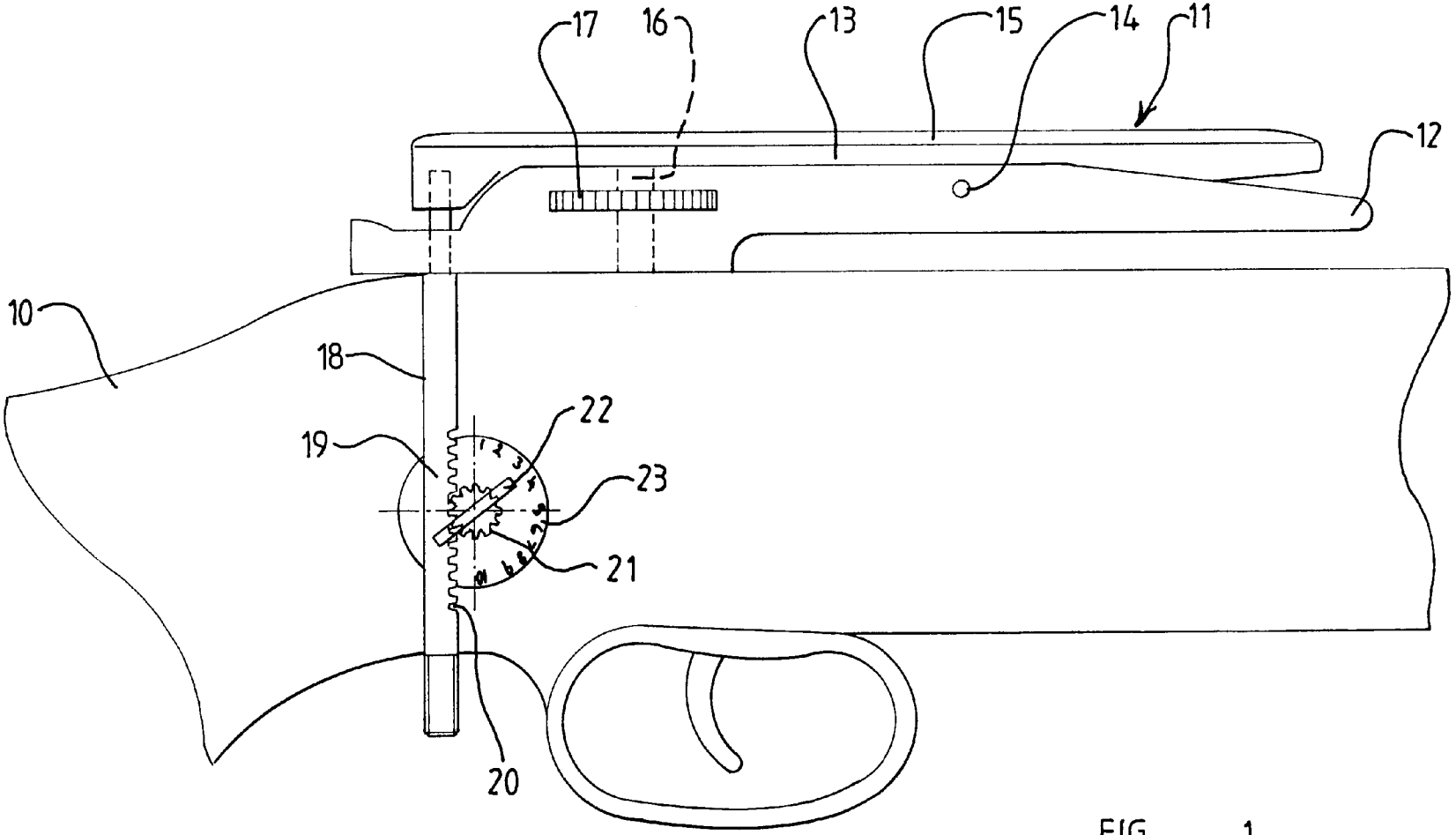

Referring to FIG. 1, the stock of a crossbow is indicated generally at 10, and at the upper part thereof there is provided a sight mounting assembly indicated generally at 11. The sight mounting assembly 11 comprises a base member 12 which is rigidly secured to the stock 10 and a sight mounting member 13 which is pivotally mounted relative to the base member 12 for pivoting movement about a transverse pivot pin 14. The sight mounting member 13, which is of elongate configuration, has a portion 15 which is of dovetail configuration to enable a sighting telescope to be secured thereto in conventional manner.

The angle at which the sight mounting member 13 is disposed relative to the base member 12 and thus relative to the stock 10 of the crossbow, is adjustable by an adjustment mechanism indicated generally at 16 and comprising a screw operable by a thumb wheel 17.

In the first embodiment, to provide a visual indication of the disposition of the sight mounting member 13 relative to the stock of the crossbow, an operating member 18 is mounted in the stock 10 of the crossbow for upward and downward movement, and is coupled with the sight mounting member 13 at the rear thereof, i.e. at a position spaced as far as practicable from the pivot pin 14. The operating member 18 may abut an abutment surface provided at the underside of the sight mounting member and be spring biased into such abutting engagement therewith. Alternatively, as shown the operating member 18 may be secured to the sight mounting member in any appropriate manner.

A central part 19 of the operating member 18 within the stock 10 is formed as a rack, as indicated diagrammatically at 20, having teeth engaging with a pinion 21 that is rotatable about a transverse axis. This rack and pinion mechanism 20, 21 operates a rotational scale and pointer indicating mechanism which as illustrated may comprise a pointer 22 movable with the pinion 21 relative to a part-circular scale 23 which is visible through an aperture in the stock 10. The position of the pointer 22 relative to the scale 23 thus provides a magnified visual indication of the movement of the sight mounting member 13, which is readily legible and shows the disposition of the sight mounting with a high degree of accuracy. The scale 23 may provide arbitrary numerical readings or readings directly indicative of the selected range in terms of distance.

In a modified embodiment, the adjustment mechanism 16 may be omitted and the pointer 22 may serve as a fingerpiece that can be gripped by the user to drive the operating member 18 and thus adjust the sight mounting member 13. In this case friction means may be provided to retain the manual operating member in any set position. Alternatively or additionally detent means may be provided to locate the manual operating member in any of a plurality of predetermined settings.

Figure 2:
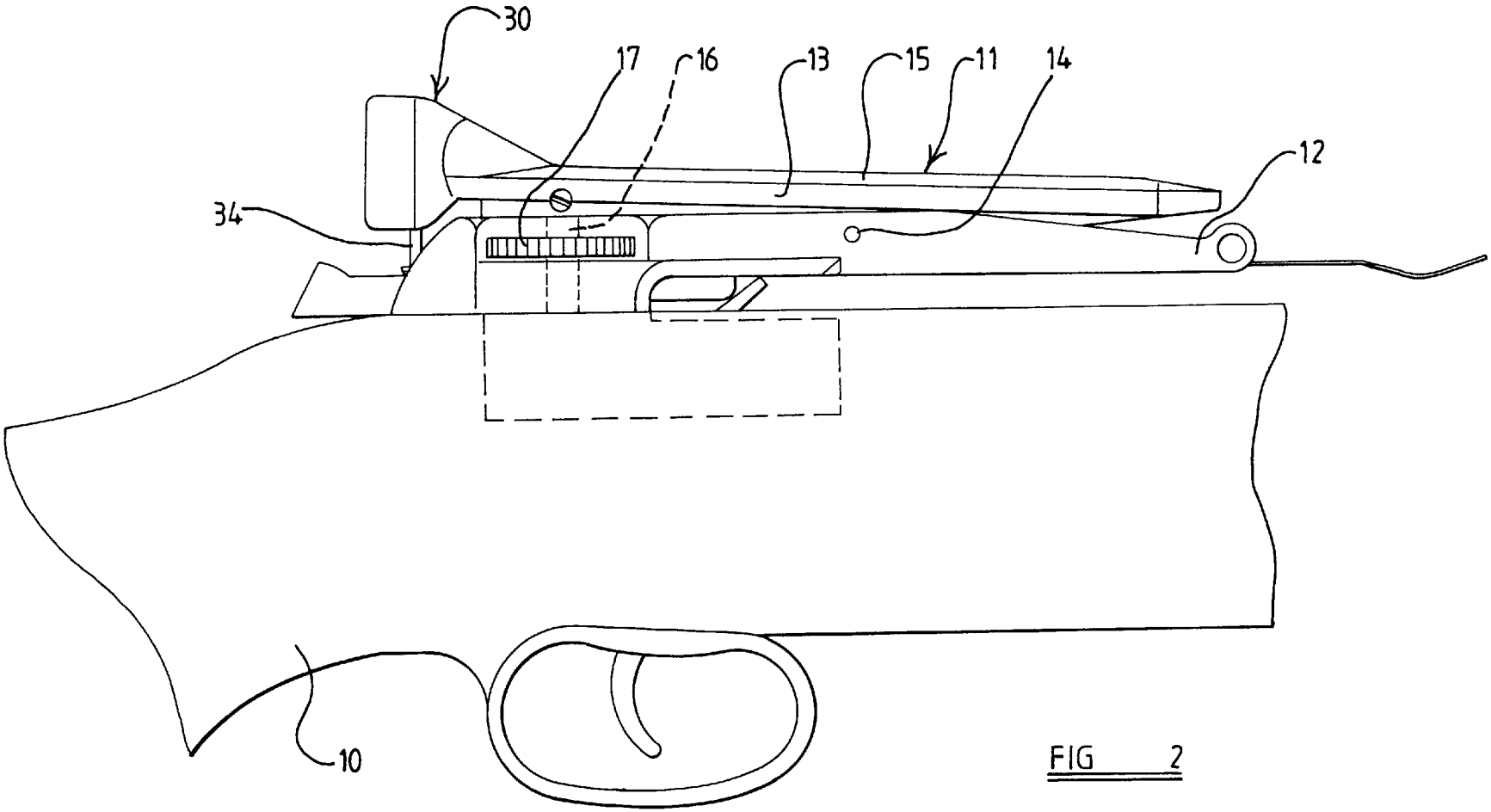
FIG. 2 shows a second embodiment of the invention also applied to a crossbow.
Figure 3:
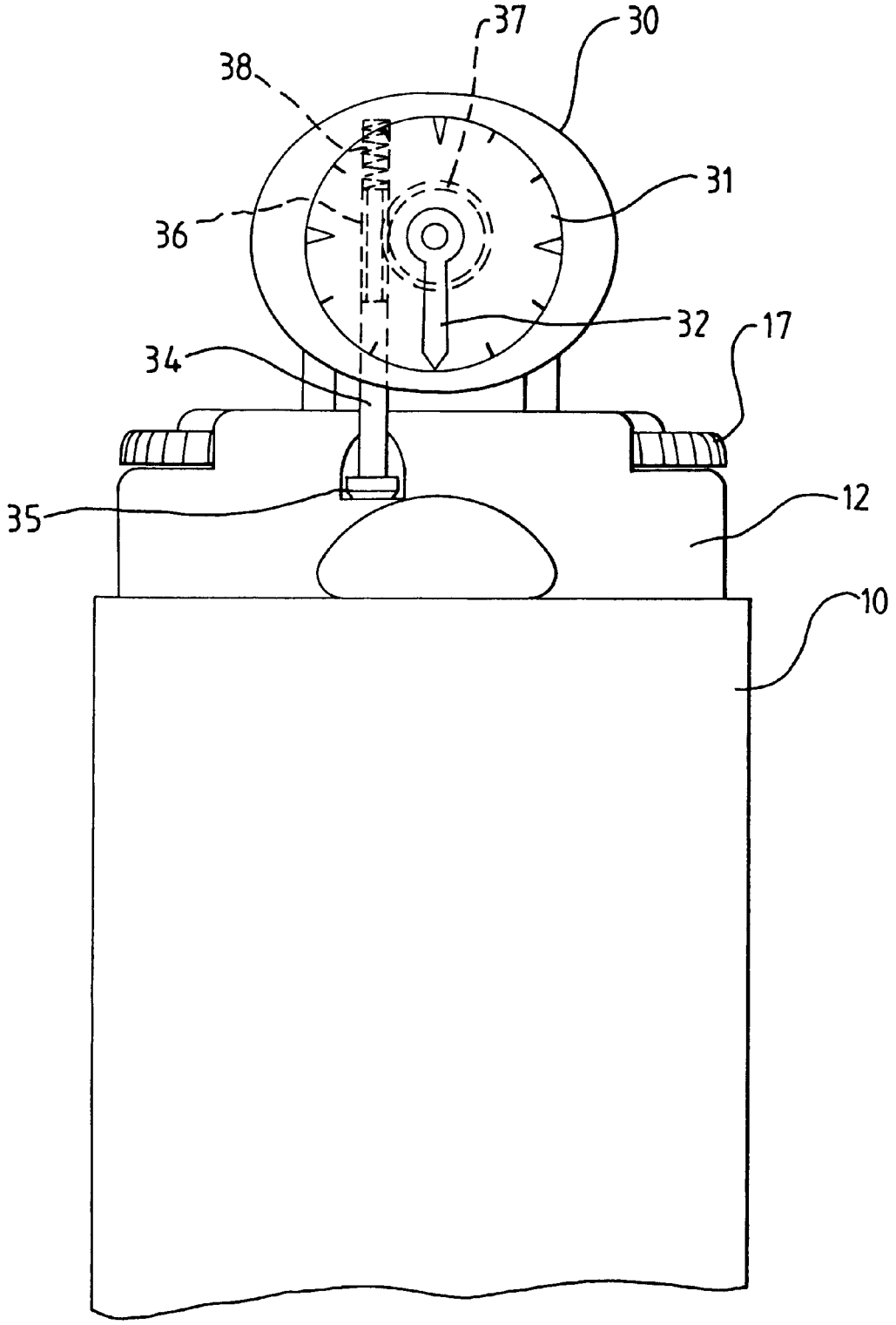
FIG. 3 is an end view of the embodiment of FIG. 2.

In the second embodiment of the invention as shown in FIGS. 2 and 3, the indicator generally shown at 30 is provided on the sight mounting member 13. The indicator 30 comprises a scale 31 and pointer 32 mechanism disposed facing in a rearward direction along the stock 10 so as to be visible to a user who is aiming the bow. An operating member 34 has a threaded portion 36 which serves as a rack to engage a toothed pinion 37 within the indicator 30, the pointer 32 being attached to said pinion 37. A resiliently deformable element comprising a compression spring 38 bears on the upper end of the operating member 34 such that a lower end part 35 of the operating member 34 is held in contact with a fixed part of the base member 12 and hence in a fixed position relative to the crossbow. Alternatively, the end part 35 could be disposed to be held in contact with a part of the stock 10.

When the adjustment mechanism 16 is operated by use of the thumb wheel 17, the sight mounting member 13 is provided relative to the transverse pivot pin 14. The height of the indicator 30 above the base member 12 will vary. Since the operating member 34 is held in a constant position relative to the base member 12, operation of the adjustment mechanism 16 will cause the position of the pinion 37 relative to the operating member 34 to change. Engagement of the pinion 37 with the threaded portion 36 of the operating member 34 will cause the pinion 37 to rotate and hence the pointer 32 to rotate relative to the scale 31. This provides a magnified visual indication of the movement of the sight mounting member 13. As in the embodiment of FIG. 1 the scale 31 may provide arbitrary numerical reading or readings directly indicative of the selected range in terms of distance.

The second embodiment may be adapted to be mounted on a standard mounting shoe and may be adapted also for use with firearms such as rifles.

Various arrangements of a mechanical scale and pointer arrangement, different from that described above, are possible. For example, the rack and pinion mechanism may cause a circular element provided on all or part of a peripheral portion therewith with a scale, to move rotationally, a part of such circular element being visible through a window in the stock of the crossbow which window acts as a pointer relative to which the scale moves. It is preferable, of course, that moving parts such as a rack and pinion mechanism or/and a scale and pointer mechanism should be substantially enclosed for protection from external influences.

A further alternative means by which a readily legible visual indication of the disposition of the sight mounting may be provided is that instead of the mechanical movement-magnifying mechanism above described there may be a means providing a digital or electronic read-out of the sight mounting disposition. There are known such devices used in, for example, measuring instruments, and such a device may be substituted for the rack and pinion and pointer and scale mechanisms above described, being mounted within the stock 10 and operable directly by the member 18 or otherwise. For example a digital numerical display of the light-emitting diode or liquid crystal types may be provided, or one of a row of L.E.D's may be energised in correspondence with the range for which the sight is set, each L.E.D. having an associated marking indicative of the respective range.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

I claim:

1. A projectile-firing weapon having mounted thereon a sight mounting member, and further comprising a) an adjustment mechanism whereby said sight mounting member is adjustable in its disposition relative to the weapon;

b) an indicator comprising a rotationally operable scale and pointer mechanism to provide a read-out indicative of the disposition of said sight mounting member, the indicator being of a size substantially greater than the range of adjustment of said sight mounting member so as to provide a readily legible visual indication of said disposition; and c) operating means for coupling said indicator to said sight mounting member in such a way as to operate the indicator by movement of the sight mounting member, said operating means comprising a mechanical movement-magnifying mechanism which includes a connecting member coupled to said sight mounting member and moveable relative to said indicator in accordance with the disposition of said sight member, and rack and pinion means connecting said connecting member with said rotationally operable scale and pointer mechanism.

2. A weapon according to claim 1 wherein said connecting member is mounted for reciprocating movement relative to the weapon.

3. A weapon according to claim 2 which comprises a stock and wherein said connecting member and said scale and pointer mechanism are located within said stock, said scale and pointer mechanism being at least partially visible through a viewing aperture formed in said stock.

4. A weapon according to claim 1 wherein said indicator is mounted on said sight mounting member.

5. A weapon according to claim 4 wherein said connecting member comprises a pin mounted in a fixed position relative to said weapon and said sight mounting member is movable relative to said pin.

6. A weapon according to claim 5 wherein said pin is held in said fixed position by a resiliently deformable element carried by said sight mounting member.

7. A weapon according to claim 5 wherein said pin is provided with a threaded portion which serves as a rack element of said rack and pinion means.

8. A weapon according to claim 1 wherein said weapon comprises a crossbow.

9. A sight mounting assembly comprising a) a base member adapted for mounting on a weapon;

b) a sight mounting member adjustably carried by said base member and adapted to carry a sighting device for the weapons;

c) adjustment means for adjusting the disposition of said sight mounting member relative to said base member through a predetermined range of adjustment;

d) indicator means mounted on said sight mounting member and comprising a rotationally operable scale and pointer mechanism to provide a read-out indicative of the disposition of said sight mounting member relative to said base member, the indicator being of a size substantially greater than the range of adjustment of said sight mounting member so as to provide a readily legible visual indication of said disposition; and e) operating means for coupling said indicator to said sight mounting member in such a way as to operate said indicator means by movement of the sight mounting member relative to said base member, said operating means comprising a mechanical movement-magnifying mechanism which includes a connecting member coupled to said sight mounting member and moveable relative to said indicator means in accordance with the disposition of said sight mounting member, and rack and pinion means connecting said connecting member with said rotationally operable scale and pointer mechanism.

10. A sight mounting assembly according to claim 9 wherein said indicator means is mounted on said sight mounting member.

11. A sight mounting assembly according to claim 10 wherein said connecting member comprises a pin mounted in a fixed position relative to said base member and said sight mounting member is moveable relative to said pin.

12. A sight mounting assembly according to claim 11 wherein said pin is held in said fixed position on said base member by a resiliently deformable element carried by said sight mounting member.

13. A sight mounting assembly according to claim 11 wherein said pin is provided with a threaded portion which serves as a rack element of said rack and pinion means.

* * * * *